US008256701B2

(12) United States Patent
Wierstra

(10) Patent No.: US 8,256,701 B2
(45) Date of Patent: Sep. 4, 2012

(54) CABLE DISPENSER

(75) Inventor: Sidney Wierstra, Grand Valley (CA)

(73) Assignee: Nexans, Paris (FR)

( * ) Notice: Subject to any disclaimer, the term of this patent is extended or adjusted under 35 U.S.C. 154(b) by 272 days.

(21) Appl. No.: 12/636,913

(22) Filed: Dec. 14, 2009

(65) Prior Publication Data

US 2011/0139921 A1 Jun. 16, 2011

(51) Int. Cl.
*B65H 49/26* (2006.01)
*B65H 49/32* (2006.01)

(52) U.S. Cl. ..... 242/588.2; 242/598.3; 242/598.5; 242/129.6

(58) Field of Classification Search ..... 242/398, 242/401, 406, 588, 598, 598.3, 598.5, 129.6, 242/588.2, 405.3, 405.2, 405, 591, 399
See application file for complete search history.

(56) References Cited

U.S. PATENT DOCUMENTS

| | | | | |
|---|---|---|---|---|
| 970,884 | A * | 9/1910 | Carter | 242/129.6 |
| 2,601,960 | A * | 7/1952 | Hick | 242/129.6 |
| 4,469,289 | A * | 9/1984 | Gebo | 242/592 |
| 4,932,601 | A * | 6/1990 | Arrington | 242/598.3 |
| 5,551,647 | A * | 9/1996 | Browning | 242/578.2 |
| 5,927,635 | A * | 7/1999 | Black et al. | 242/395 |
| 6,199,786 | B1 * | 3/2001 | Lessard et al. | 242/406 |
| 6,352,215 | B1 | 3/2002 | Cash et al. | |
| 2006/0266877 | A1 * | 11/2006 | Feather | 242/598.3 |

* cited by examiner

*Primary Examiner* — William E Dondero
(74) *Attorney, Agent, or Firm* — Sofer & Haroun, LLP

(57) ABSTRACT

A stand for delivering coiled cable has first and second side elements, each of which has a wide flat base portion and a tall central column. First and second bottom braces are configured to connect the first and second side elements near the flat base portions. A third handle brace is configured to connect the first and second side elements near the tall central columns. A shaft is configured to be positioned between the first and second side elements, with the shaft configured to receive a cable spool, such that when the spool is positioned on the shaft between the first and second sides, cable from the spool may be allowed to be removed from the spool by spinning the spool on the shaft. The cable can not exit the spool and fall between the outside of the spool and the insides of the first and second side elements.

2 Claims, 10 Drawing Sheets

CABLE DISPENSER

BACKGROUND

1. Field of the Invention

The present application relates to electrical cable. More particularly, the present application relates to a packaging and dispenser for wire and cable, henceforth referred to as "cable".

2. Description of Related Art

In the field of cable installation, such as power or signal cables, cable is typically pre-wound on a spool which is in turn set up on an axel, such as a broom handle or pipe, so it can rotate freely, as the cable is withdrawn from the spool during installation. For example with power cable, the spools unwind at the speed with which the installer is pulling the cable through the joist holes. Sometimes when the cable is pulled quickly, the spool continues to turn when the pull is done and the cable will jump off the spool and get tangled on the axel. See for example, prior art FIG. 1 showing such an arrangement.

Moreover, the spool may wander on the axel which further complicates installation. For example, the spool has to be placed more or less perpendicular to the pull or the cable will not de-reel smoothly. Thus, the installer has to continually intervene to fix the payoff and cable during the pull. If these interventions can be avoided, this will speed up the pulling of cables. Installers do not want complicated devices to load the cable into.

Alternatively, spool payoff stands can be purchased, but in principle, they behave no differently than spools on a broom handle. See for example, prior art FIG. 2 showing such a spool payoff stand.

In order to reduce packaging costs, there are separate manners for cable packaging where cables are simply coiled and packaged in shrink wrap with no central spool.

The setup that is used most often for shrink wrapped packages is to place cable from the opened shrink-wrap package onto a holder, which then is placed on the axel or onto a payoff device as shown in prior art FIG. 3. Because the diameter of typical shrink wrapped cable spools are bigger (e.g. to make the shrink wrap package more stable on the skid for shipping reasons), it spins more readily but continues to rotate after the installer stops pulling, then the cable jumps over the flange holder onto the axel, or on other occasions just unravels on the holder and cause tangles that are worse than the tangles from spools. Also, if the cable is pulled off with a sharp fleeting angle from such a device, the cable jumps off the holder more easily.

Another manner for handling non-spooled shrink wrapped cables is to use a device such as the one shown in Prior art FIG. 4, from U.S. Pat. No. 6,352,215. This device works essentially by allowing the installer to load the non-spooled cable onto an empty spool. However, such a device is difficult to load the cable onto, and thus is time consuming to operate. Additionally, such a device still suffers from the same over-rotation problem described above. Likewise, this device is complex and heavy and thus is expensive and difficult to maneuver on job sites.

OBJECTS AND SUMMARY

The present arrangement overcomes the drawbacks associated with payoff of both spooled and non-spooled (shrink-wrapped) cable, such as coiled electrical cables, by providing a payoff that is enclosed so that the cable will not jump over the flanges of the spool. The payoff arrangement is lightweight and sturdy and is both easy to manufacture and easy to load, while remaining stable under the heavy weight and forces applied while unwinding the cable.

In one embodiment, a device is provided with a lightweight construction having a wide base that is stable during uncoiling of cable. The device advantageously includes a central axel with a tension brake to prevent over-spinning. The device may be advantageously configured to support either one of pre-spooled cable or non-spooled (shrink-wrapped) cable.

To this end, a stand for delivering coiled cable. The stand has first and second side elements, each of which has a wide flat base portion and a tall central column. First and second bottom braces are configured to connect the first and second side elements near the flat base portions. A third handle brace is configured to connect the first and second side elements near the tall central columns.

A shaft is configured to be positioned between the first and second side elements, with the shaft configured to receive a cable spool, such that when the spool is positioned on the shaft between the first and second sides, cable from the spool may be allowed to be removed from the spool by spinning the spool on the shaft. The cable can not exit the spool and fall between the outside of the spool and the insides of the first and second side elements.

BRIEF DESCRIPTION OF THE DRAWINGS

The present invention can be best understood through the following description and accompanying drawings, wherein.

DETAILED DESCRIPTION

Figure 1:
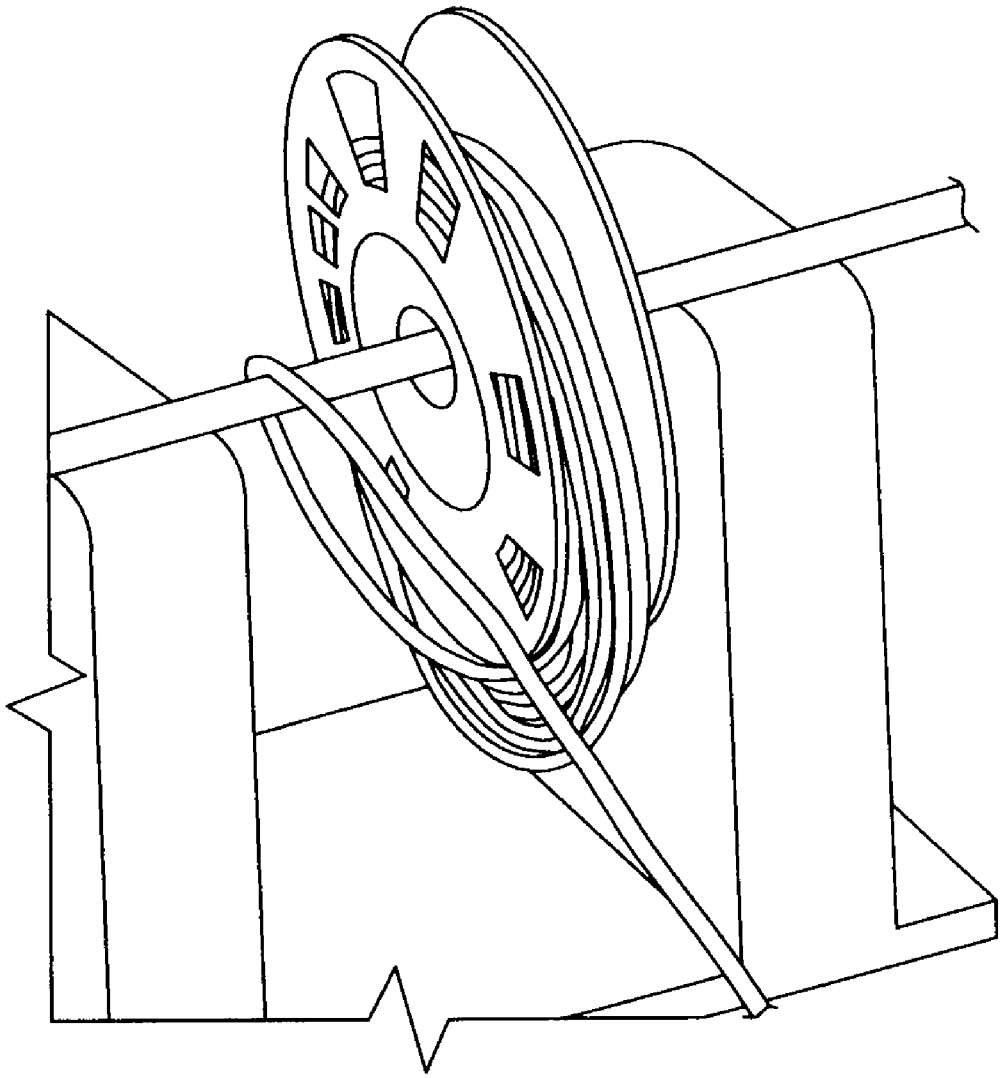
FIG. 1 (PRIOR ART)
FIG. 1 is a prior art arrangement of cable spool on an axel, such as a broom handle or pipe.
Figure 2:
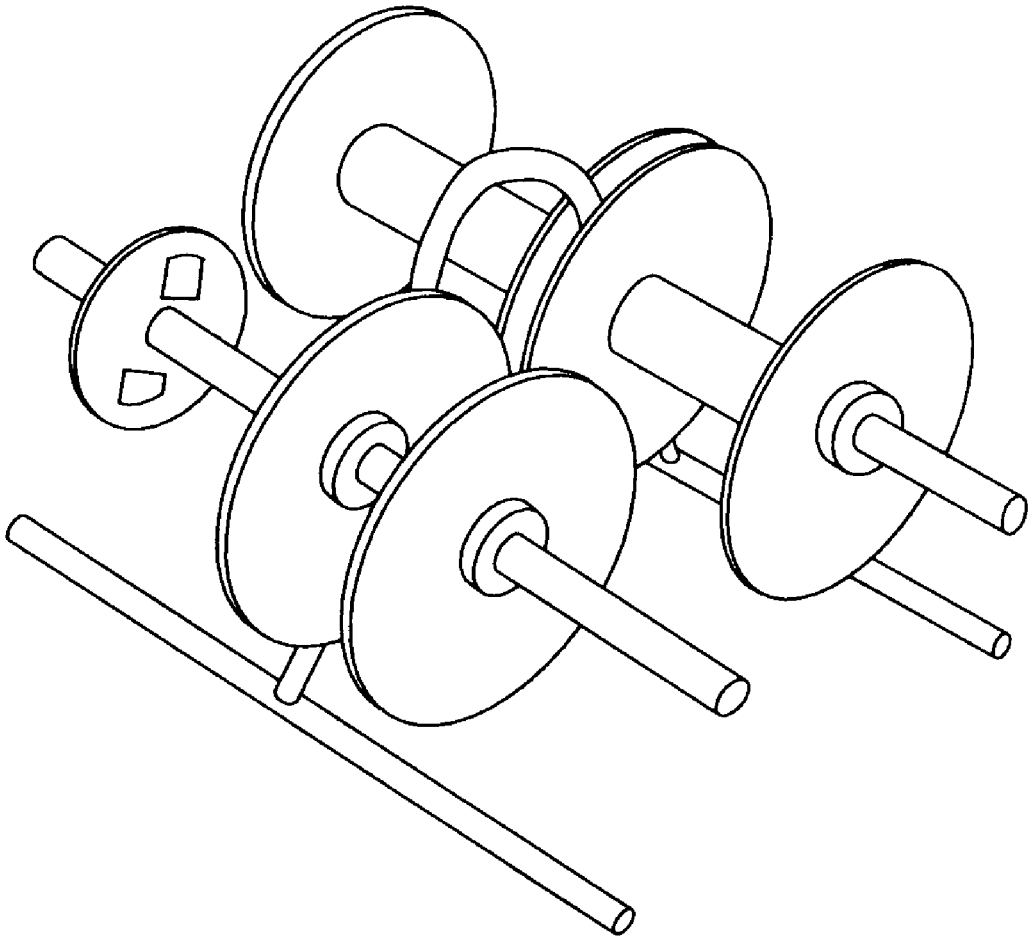
FIG. 2 (PRIOR ART)
FIG. 2 is a prior art arrangement of a cable spool payoff stand.
Figure 3:
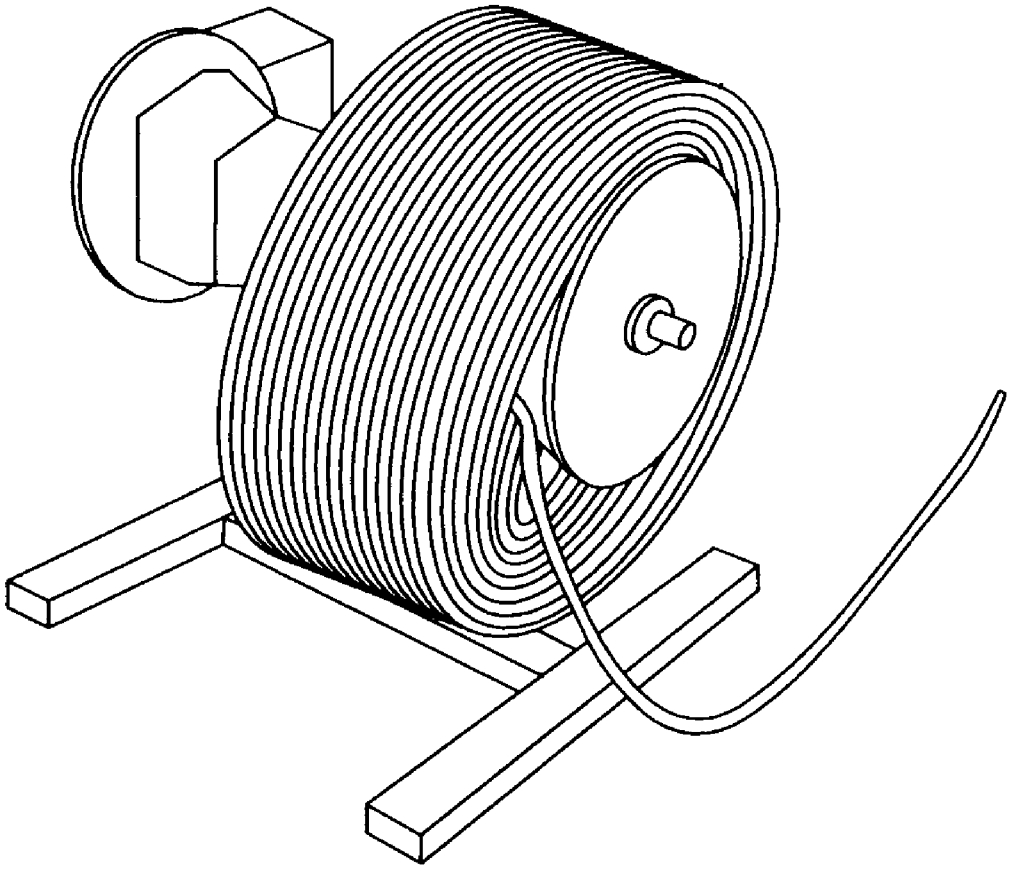
FIG. 3 (PRIOR ART)
FIG. 3 is a prior art arrangement of a non-spooled cable payoff stand.
Figure 4:
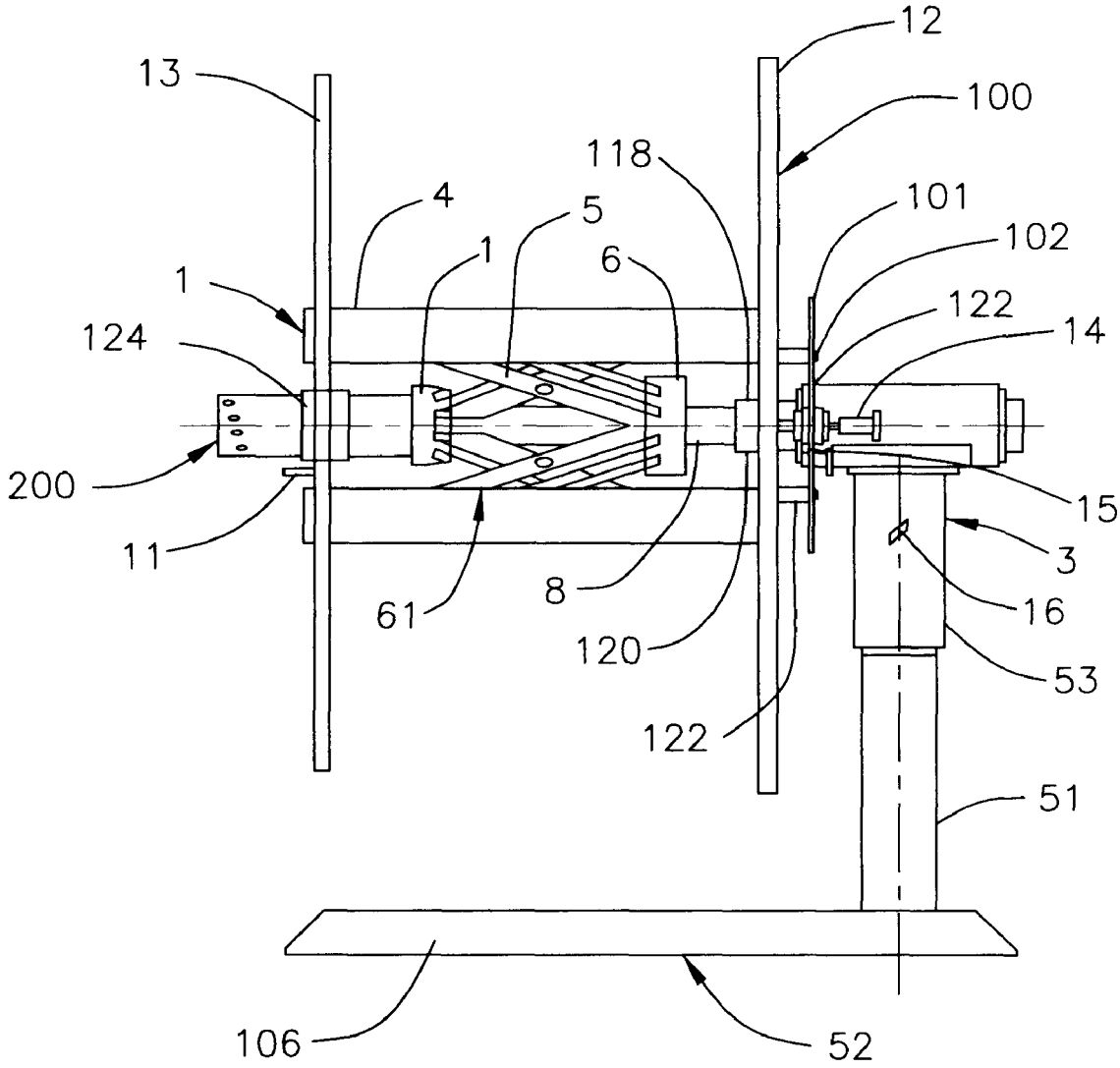
FIG. 4 (PRIOR ART)
FIG. 4 is a prior art arrangement of a non-spooled cable payoff stand.
Figure 5:
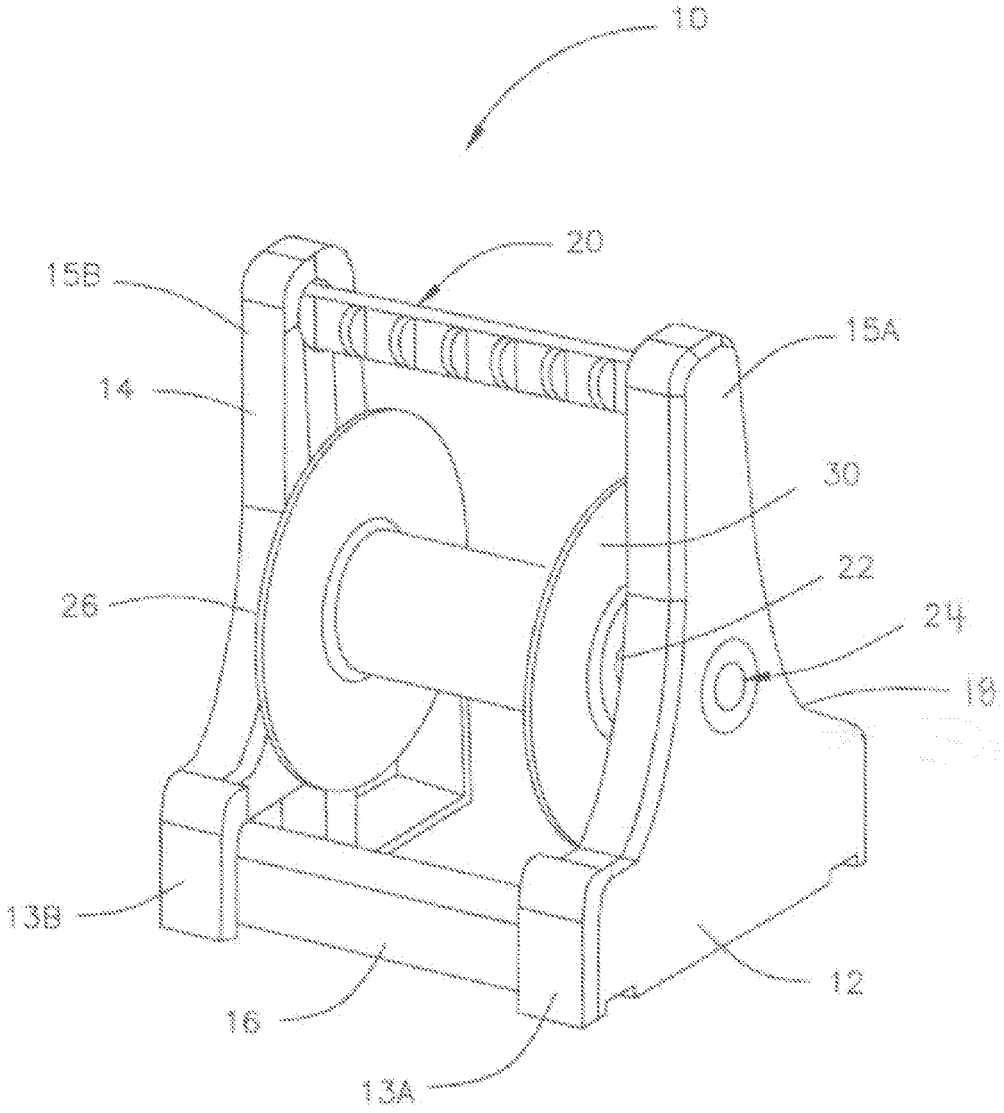
FIG. 5 shows a cable spool payoff stand in accordance with one embodiment.

In one arrangement, as illustrated in FIG. 5, a cable spool payoff stand 10 (stand 10) is shown. Stand 10 includes first and second side bodies 12 and 14. Preferably, sides 12 and 14 are constructed of a strong lightweight polymer that is both stable under the conditions of being loaded with a cable spool, yet light enough to be moved easily around a work site by an installer.

Sides 12 and 14 are dimensioned to have each have wide base regions 13*a* and 13*b* respectively, with tall central columns 15*a* and 15*b* respectively. Such shape for sides 12 and 14 provide stand 10 with a wide flat base on either side of a cable spool 30 ensuring that under loaded conditions, the center of gravity for stand 10 is low, preventing the spool from flipping over when an installer is removing cable from stand 10. Tall central columns 15*a* and 15*b*, are thin (in keeping with the low flat design) but are strong enough to provide a support for a handle and to prevent the cable from slipping over the top of spool 30 as described in more detail below.

First and second bottom braces 16 and 18 are configured to secure sides 12 and 14 to one another at the base regions 13, as shown in FIG. 5. Typically braces 16 and 18 are permanently coupled to sides 12 and 14. However, in one alternative arrangement, braces 16 and 18 may be removable, possibly dimensioned for friction fit into corresponding openings on the inside walls of sides 12 and 14. This alternative arrangement may be employed for periodic maintenance to the stand 10. An additional top brace handle 20 is similarly dimensioned to fit between sides 12 and 14.

As shown in FIG. 5, shaft 22 is configured to be placed in between two bearing flanges 24 and 26 in side walls 12 and 14 respectively when stand 10 is loaded as described below. As shown in FIG. 5, shaft 22 supports cable spool 30 to allow the installer to remove cable in an easy manner.

Figure 6:
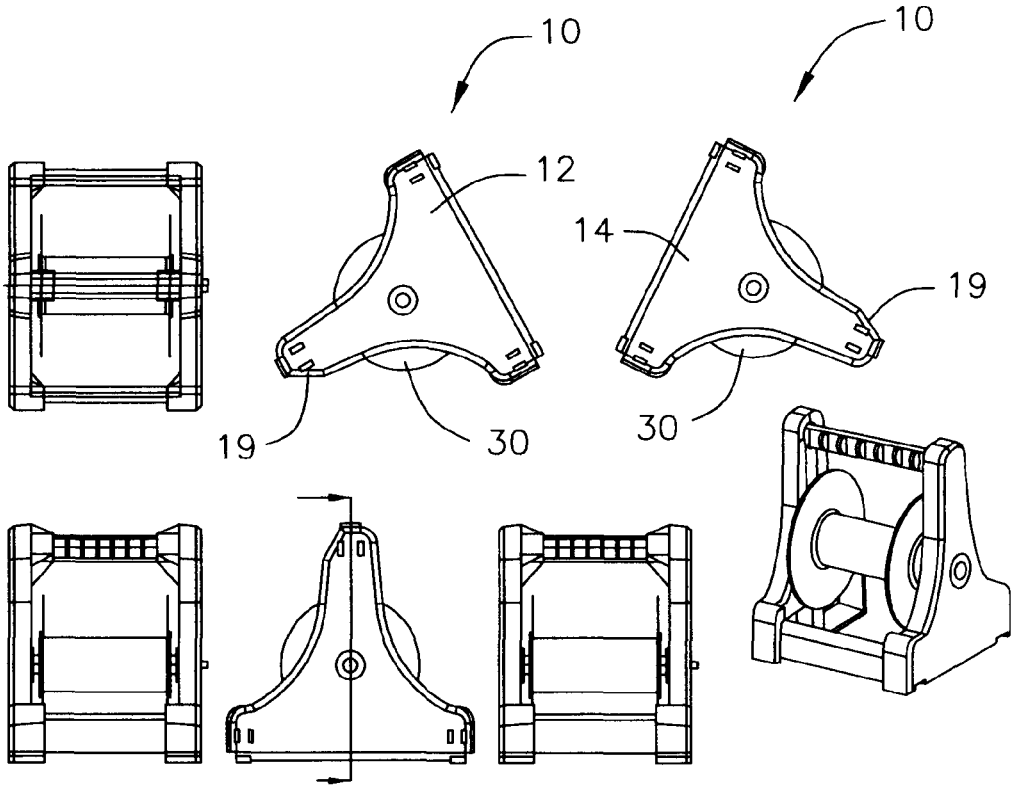
FIG. 6 shows a cable spool payoff stand capable of accepting 2 different spool sizes, in accordance with one embodiment.

In order to load a spool 30 into stand 10, stand 10 is tipped over so that the tall central portions is are placed against the ground. As shown in FIG. 6, sides 12 and 14, each in the shape of a triangle, are such that when stand 10 is positioned on its side, the hole in the center of spool 30 lines up vertically (from the floor) with the holes in the sides 12 and 14 at flanges 24 and 26 (for shaft 22). Thus with a tipped stand 10, a spool 30 may be placed on the ground within the center of stand 10 with its central opening aligned with shaft 22 openings in stand 10, thus making it very easy to slide in the shaft 22.

In one arrangement, also shown in FIG. 6, tall central portions 15 on sides 12 and 14 may have a dimensioned notch 19 facing one side of stand 10. This dimensioned notch 19 is such that the opening at flanges 24 and 26 are disposed at two different heights from the floor depending on which direction stand 10 is flipped. For example, notch 19 may be such that if stand 10 is tipped in that direction, flanges 24 and 26 for shaft 22 would be 20" from the ground (measured from the center of the opening), whereas if stand 10 is flipped to the loading position in the direction opposite notch 19, flanges 24 and 26 for shaft 22 would be 22" from the ground. Such an arrangement allows for one stand 10 to be used to two different size spools 30 (e.g. a spool 30 with 20" side flanges versus a spool 30 with 22' side flanges), using the same loading procedure as described in the preceding paragraph. It is noted that the two heights described above are exemplary only. It is understood that stand 10 constructed accordingly may be dimensioned to easily accept spools of any two different dimensions that can be accommodated by a differently sized notch 19 in central portions 15 of sides 12 and 14.

Figure 7:
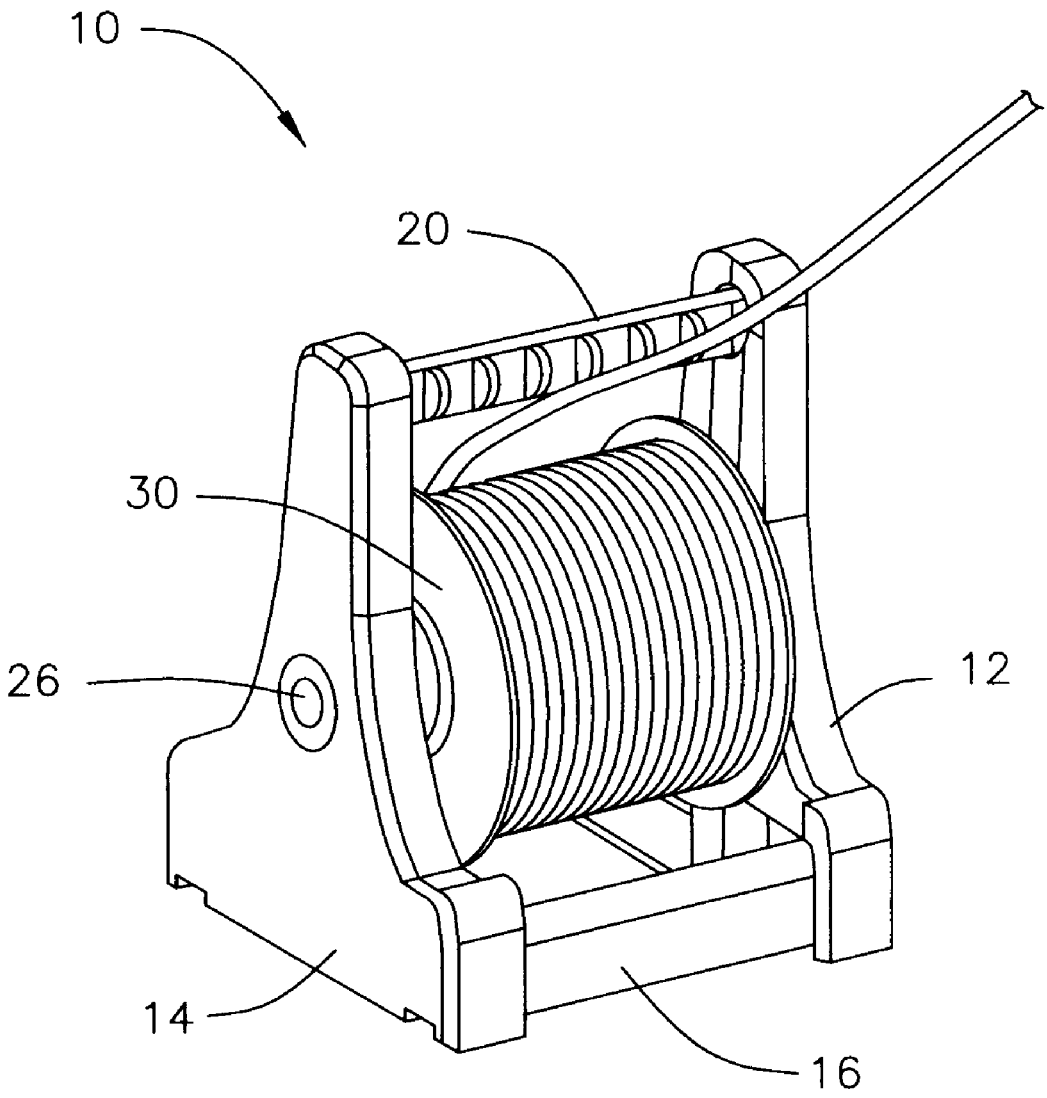
FIG. 7 shows the cable spool payoff stand of FIG. 5 with a cable spool thereon in accordance with one embodiment.

When shaft 22 is inserted and locked in place and stand 10 turned up-right and the cable is allowed to rotate without obstruction from the floor. As shown in FIG. 7, the cable on stand 10 may then be pulled off of spool 30 for installation by the installer. The wide base portions 13*a* and 13*b* of sides 12 and 14 keep the weight of spool 30 low and evenly distributed. Thus, even if the installer begins to pull the cable in a direction transverse to the normal payoff direction of the spool's wide base, 13*a* and 13*b* prevent stand 10 from tipping. Also, tall central portions 15*a* and 15*b* of sides 12 and 14 are separated sufficiently from the edges of spool 30 to allow it to spin (or with shaft 22), yet close enough to prevent a payoff cable from slipping up, over the edge of spool 30, and then down the outside of spool 30 onto shaft 22, causing jam. This design alleviates several of the drawbacks with prior art payoff arrangements, providing stable yet lightweight/portability, using an inexpensive and easy to use/manufacture design.

In one arrangement, shaft 22 and bearing flanges 24 and 26 may be fixed relative to spool 30, thus allowing spool 30 simply to spin around a secured shaft 22. In an alternative arrangement, shaft 22 may be free spinning on bearing flanges 24 and 26. In this arrangement, when spool 30 is spun during payoff, not only spool 30 but also shaft 22 may spin.

Figure 8A:
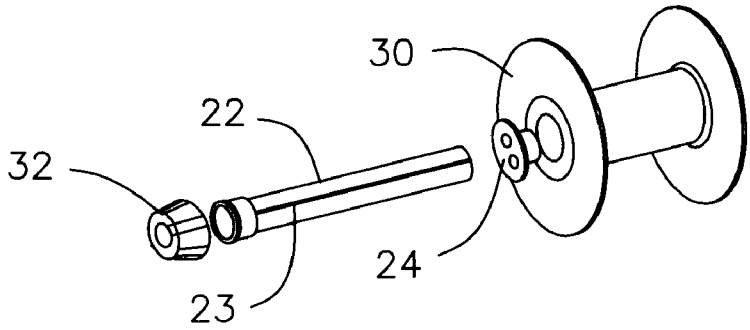
FIGS. 8A, 8B and 8C show a cable spool payoff stand in accordance with one embodiment.
Figure 8B:
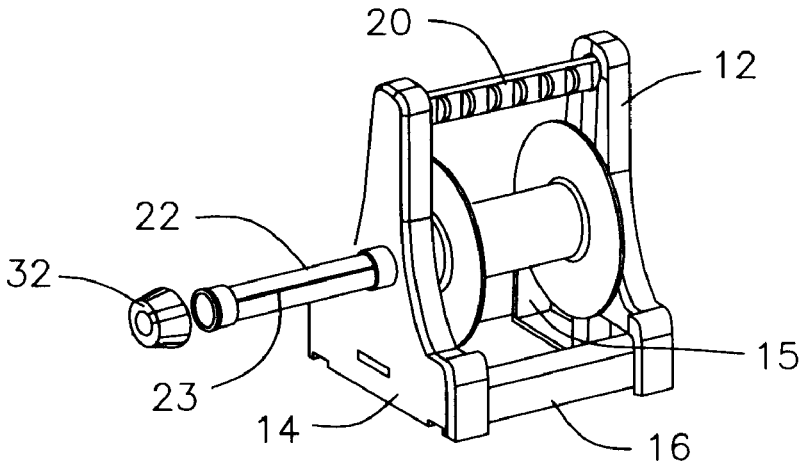
Figure 8C:
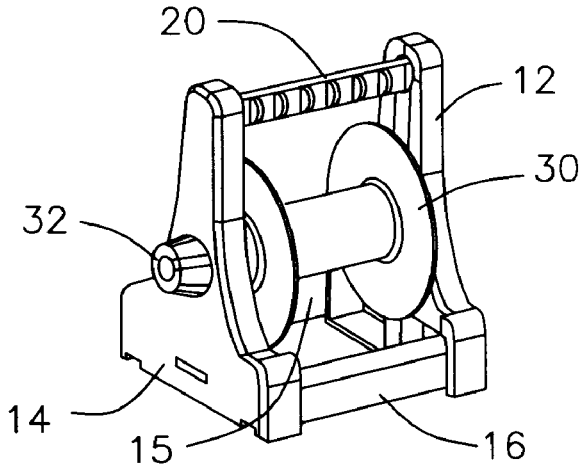

In an alternative arrangement, as shown in FIGS. 8A-8C, (using the same element numbers as identified above) shaft 22 is splined (with splines 23 that contact the inside of spool 30) and fitted with a tension nut/end cap 32. As above, once stand 10 is tipped and a spool 30 is placed inside, shaft 22 is inserted and stand 10 is turned upright. When the installer pulls on the cable, spool 30 spins allowing the cable to release. In certain prior art arrangements, after the pull, the cable may continue to "over-spin" causing several coils of the cable to come off spool 30, leading to a potential jam. The arrangement of tension nut/cap 32 allows the back-tension of spool 30 on shaft 22 to be adjusted, so that it requires only a little more tension to pull the cable, but once the cable pull is complete, spool 30 and shaft 22 come to stop quickly under the back-tension to prevent over-spinning. The level of braking may be adjusted by tightening and loosening tension nut/cap 32.

Figure 9A:
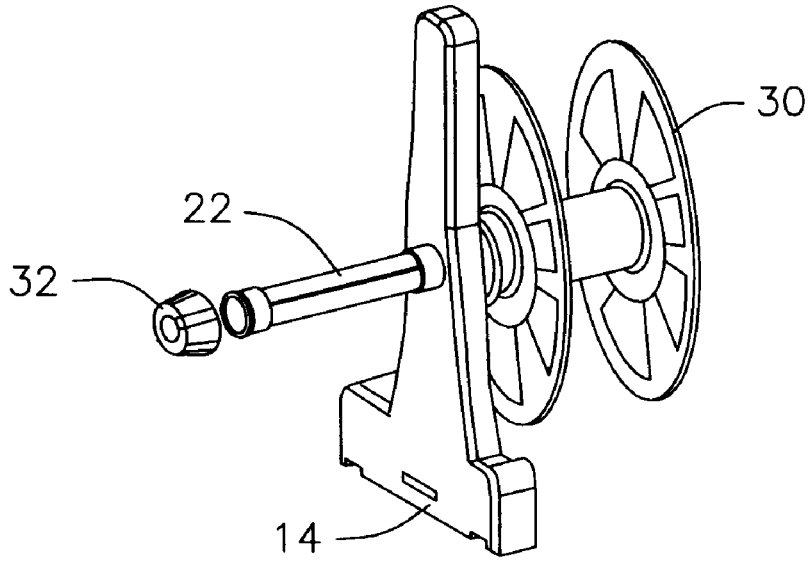
FIGS. 9A and 9B show a cable spool payoff stand in accordance with one embodiment.
Figure 9B:
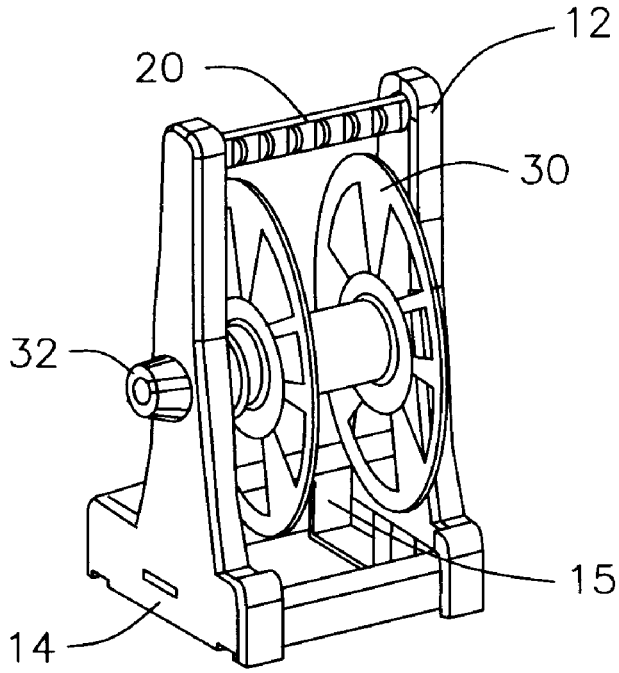

In an alternative arrangement, FIGS. 9A and 9B illustrate stand 10 for use with shrink wrapped cable that does not come pre-spun on spool 30. In this arrangement, spool 30 is a separate item from the cable to be placed thereon. Sides 12 and 14 are dimensioned to be slight taller and braces 16, 18 and 20 slightly shorter, to account for the thinner and larger diameter cable (as it is typically arranged when shrink-wrapped). As with the arrangement of FIGS. 5, 6 and 7, shaft 22 may be loose, or, as with the arrangement described in FIGS. 8A-8C, a tension nut 32 may be used.

Figure 10A:
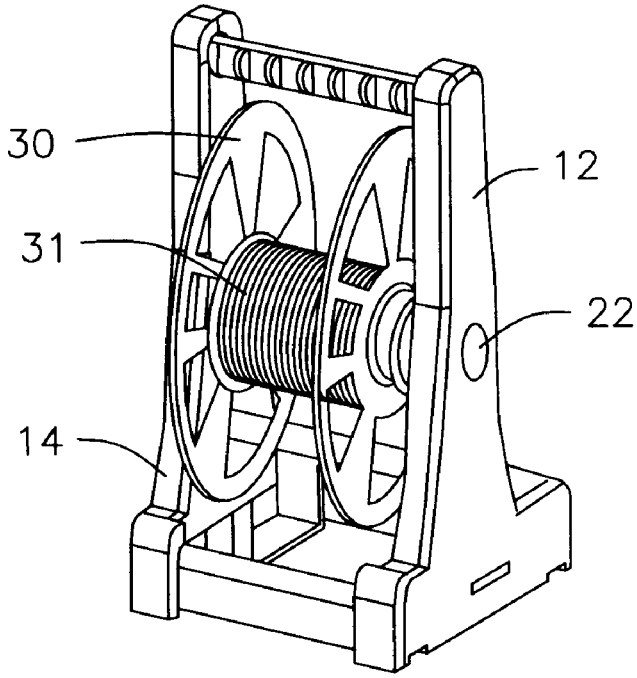
FIGS. 10A and 10B show a cable spool payoff stand of FIGS. 9A and 9B, in accordance with one embodiment.
Figure 10B:
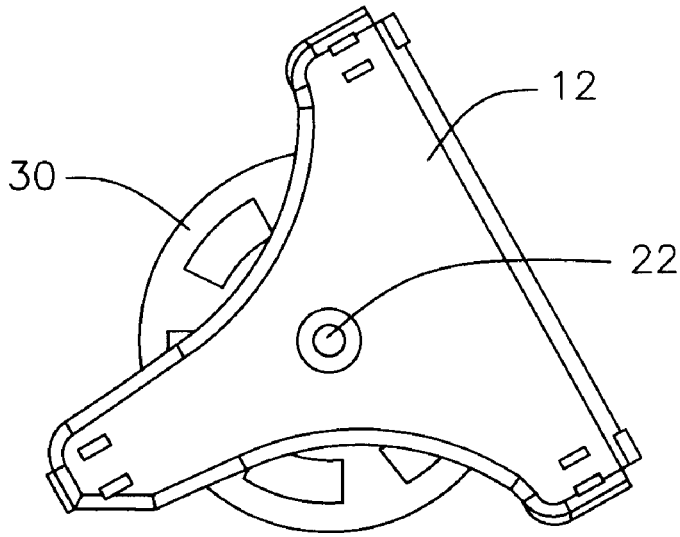

In this arrangement, once the cable is obtained, one flange of spool 30 is unthreaded on one side, or other means, and the cable is inserted onto a drum 31 of spool 30 with the unthreaded flange then being replaced. The threaded drum 31 and removable flange are shown in FIG. 10A When loading, as with the previous designs, stand 10 is rotated 120 degrees as shown in FIG. 10B. Spool 30, with the cable thereon, is placed within stand 10 and shaft 22 is inserted into sides 12 and 14. As with the prior designs the height of the openings for shaft 22 is preferably equal to the height of the center opening of drum 31 of spool 30 so that it can be left on the floor during installation. From here, the installer may remove the cable for installation as described above.

It is noted that drum 31 of spool 30 preferably is constructed having an inner drum diameter substantially equal to the inside diameter of a shrink-wrap package of cable, allowing for easy centering the shrink-wrap package. This version of spool 30 is constructed so that it can accept various widths of shrink-wrap package and suitable for multiple cable sizes and lengths typical in the industry. In the illustration, the threading on drum 31 of spool 30 for the removable flange is on the outer surface of that central drum. Other methods are possible and envisioned in the invention but not specified here, such as clasps to lock the wheel in place in place of threads.

As with the above designs, the flanges of spool 30 are constructed sufficiently high so that the cable will not easily jump over and cause tangles. Likewise, the clearance between both brace 20, as well as sides 12 and 14, and holder 30 are kept at a minimum distance to avoid having the cable jump off.

Drum 30 of this construction may be used with stand 10 or conveniently removed and used with other axels for the dispensing of the cable. It is not necessary to use one complete device per shrink-wrap package.

While only certain features of the invention have been illustrated and described herein, many modifications, substitutions, changes or equivalents will now occur to those skilled in the art. Therefore, it is to be understood that this application is intended to cover all such modifications and changes that fall within the true spirit of the invention.

What is claimed is:

1. A stand for delivering coiled cable, said stand comprising:

first and second side elements, each of which has wide flat base portion and a tall central column;

at least one brace configured to connect said first and second side elements near said flat base portions;

a handle brace configured to connect said first and second side elements near said tall central columns;

a shaft configured to be positioned between said first and second side elements, said shaft configured to receive a cable spool having at least one opening, such that when said spool is positioned on said shaft between said first and second sides, cable from said spool may be allowed to be removed from said spool by spinning said spool on said shaft and wherein when said stand is tipped on its side so that said tall central column of said first and second sides is placed on said ground, openings in said first and second side elements for said shaft are substantially equal in height to said at least one opening of said spool, so that said shaft may be inserted through said first and second sides and said spool.

2. A stand for delivering coiled cable, said stand comprising:

first and second side elements, each of which has wide flat base portion and a tall central column;

at least one brace configured to connect said first and second side elements near said flat base portions;

a handle brace configured to connect said first and second side elements near said tall central columns;

a shaft configured to be positioned between said first and second side elements, said shaft configured to receive a cable spool having at least one opening, such that when said spool is positioned on said shaft between said first and second sides, cable from said spool may be allowed to be removed from said spool by spinning said spool on said shaft and wherein when said stand is tipped on it side so that said tall central column of said first and second sides is placed on said ground, openings in said first and second side elements for said shaft are substantially equal in height to said at least one opening of said spool, so that said shaft may be inserted through said first and second sides and said spool, wherein said tall central column has a notch so that the height of said openings in said first and second side elements for said shaft are positioned at a first height when tipped in the direction of said notch and a second taller height when tipped in the direction opposite of said notch.

* * * * *